United States Patent [19]

Dmitriev et al.

[11] Patent Number: 4,461,972

[45] Date of Patent: Jul. 24, 1984

[54] CHARGED PARTICLE ACCELERATOR VACUUM CHAMBER

[76] Inventors: Stanislav P. Dmitriev, Michurinskaya ulitsa, 19, kv. 23; Anatoly K. Evseev, ulitsa Bukharestskaya, 33, korpus 1, kv. 23; Andrei S. Ivanov, ulitsa Kuznetsovskaya, 8, kv. 33; Leonid V. Komorin, poselok Metallostroi, ulitsa Pushkinskaya, 8, kv. 35; Vladimir I. Nikishkin, ulitsa Yaroslava Gasheka, 2, kv. 459; Stanislav N. Nuzhny, poselok Metallostroi, ulitsa Bogaichuka, 10, kv. 27, all of Leningrad; Mikhail K. Rex, ulitsa Kievskaya, 92, kv. 25, Simferopol; Mikhail P. Sviniin, poselok Metallostroi, ulitsa Bogaichuka, 4, kv. 25; Mikhail T. Fedotov, poselok Metallostroi, ulitsa Polovaya, 22, kv. 58, both of Leningrad, all of U.S.S.R.

[21] Appl. No.: 346,051

[22] PCT Filed: May 30, 1980

[86] PCT No.: PCT/SU80/00087

§ 371 Date: Jan. 26, 1982

§ 102(e) Date: Jan. 26, 1982

[87] PCT Pub. No.: WO81/03597

PCT Pub. Date: Dec. 10, 1981

[51] Int. Cl.[3] ..... H01J 33/04

[52] U.S. Cl. ..... 313/420

[58] Field of Search ..... 313/420, 359.1, 363.1

[56] References Cited

U.S. PATENT DOCUMENTS 2,820,168 1/1958 Stiff ..... 313/420

3,105,916 10/1963 Marker et al. ..... 313/420 X

*Primary Examiner*—Eugene R. LaRoche

*Assistant Examiner*—Vincent DeLuca

*Attorney, Agent, or Firm*—Fleit, Jacobson, Cohn & Price

[57] ABSTRACT

A charged particle accelerator vacuum chamber comprises an exit window adapted for extracting charged particles into the atmosphere, having at least one foil (1) secured in a frame (2), and guide slots (4) provided along a longer side of the exit window, the frame (2) being inserted into said slots (4).

4 Claims, 4 Drawing Figures

CHARGED PARTICLE ACCELERATOR VACUUM CHAMBER

FIELD OF THE INVENTION

The present invention relates to accelerator technique, and more particularly to charged particle accelerator vacuum chambers.

BACKGROUND OF THE INVENTION

A vacuum chamber is an element of charged particle accelerators of commercial type used, for example, for chemical and radiation treatment of materials and is intended to extract the beam of charged particles formed by the accelerator into an atmosphere. The beam passes through an exit window of the vacuum chamber, made of thin metal foil, which separates the vacuum volume of the accelerator from the atmospheric pressure.

Known to the prior art is a vacuum chamber (cf. U.S. Pat. No. 3,778,655 published in 1973), wherein the foil is fixed between a vacuum chamber flange and a clamping flange by screws spaced along the periphery of the foil.

Replacing of the foil in the course of operation is a complicated time-taking process, since the foil is fixed simultaneously with mounting of the clamping flange, and because assembling of the unit is performed in a tight room limited by pipelines of a watercooling system of the chamber and a conveyor, transferring products to be irradiated. Moreover, fixation of the foil in the chamber may prove to be not sufficiently vacuum-tight.

Also known is a charged particle accelerator vacuum chamber, described in a dissertation work by G. S. Krainov "Uskoritel electronov dla pricladnych tselei (constructsia i raschot)", Novosibirsk, 1975. The exit window of this vacuum chamber represents a frame with a foil and a flange, to which the frame is secured. The frame consists of two flanges screwed together with a foil therebetween fixed in a vacuum-tight manner. This frame is connected to the flange of the vacuum chamber through a gasket by screws, spaced along the periphery of the window, as in the above-described vacuum chamber.

Replacing the foil of the exit window in such a vacuum chamber is performed by replacing the frame, which is assembled and leakage tested previously and not on the accelerator, but on a special working place, this being undoubtedly much more convenient as compared to the fixing operation of the foil in the vacuum chamber according to U.S. Pat. No. 3,778,655. Moreover, a more reliable vacuum seal between the foil and the chamber is gained. However, the replacing of the frame in this vacuum chamber is still a labour-consuming operation, requiring to unscrew completely all screws fastening the frame to the flange and then to tighten them again, the number of the screws, assuming the length of the exit window to be 1 meter, being from 30 to 50. Further, to achieve a leakage-tight connection of the foil to the vacuum chamber, the frame should be sufficiently bulky, this also being a problem in mounting the frame within a limited room.

Besides, the design of the vaccum chamber is rather complicated since a second vacuum seal and a second set of screws is added.

SUMMARY OF THE INVENTION

It is an object of the present invention to provide a charged particle accelerator vacuum chamber simple in design and easy in operation.

The principal object of the present invention is to provide a vacuum chamber of a charged particle accelerator, whose exit window should be mounted on a flange so as to reduce time required to replace the foil.

With this principal object in view, there is provided a vacuum chamber of a charged particle accelerator, comprising an exit window to extract charged particles to the atmosphere, including at least one foil secured in a frame, and a flange, on which the exit window is mounted, wherein, according to the invention, the longer side of the exit window has guide slots, the frame being inserted into said slots.

Replacing of the foil in the vacuum chamber of the proposed design is less labour-consuming due to the fact that the frame with the foil is fixed in the guide slots and is removed by sliding it out from the guide slots. Therefore the frame may not have holes for screws to clamp it to the flange, which makes the frame more rigid and less bulky. Moreover, to slide the frame out of the slots the screws need not to be unscrewed completely but only to be loosened sufficiently to allow the frame to slide freely in the guide slots. This results in saving the time required to replace the frame.

According to one embodiment of the present invention, the guide slots are manufactured in the inner part at the flange, the latter having through slits along the shorter side of the exit window to allow the frame to enter the guide slots and to remove the frame out from the slots.

In case the exit window of the vacuum chamber accommodates two foils forming a gas cooling channel therebetween, the vacuum chamber may additionally have two racks and a clamping flange. The racks are arranged along the longer sides of the exit window and adjoin to the flange, the guide slots being made in said racks and the frame having projections to enter the guide slots and a clamping flange connected to the aforementioned flange by coupling bolts passed through holes in the racks, said clamping flange having spring-biased supports pressing against the racks and providing, when the coupling bolts are weakened, a gap between the clamping flange and the nearest foil to allow the frame to enter the guide slots and to remove the frame out from the slots.

Such a design eliminates any damage of the lower foil i.e. the foil facing the product to be irradiated while mounting the frame onto the vacuum chamber.

It is expedient that the vacuum chamber has at least one additional plank fixed on guiding pins fastened to the shorter side of the frame and movable with respect to the frame, one end of the foil being secured to the other shorter side, and another end of the foil, to the movable plank, and tensioning bolts screwed into the movable plank and pressing by their ends against the frame to move the plank with respect to the frame thus adjusting the foil tension on the frame.

Adjustment of foil tension on the frame allows to avoid wrinkles during vacuuming of the chamber and, hence, to reduce concentration of mechanical stress at the foil and to decrease local overheating of the foil.

The present invention will be best understood from a consideration of the following detailed description of embodiments thereof with reference being made to the accompanying drawings.

BEST MODES TO CARRY OUT THE INVENTION

Figure 1:
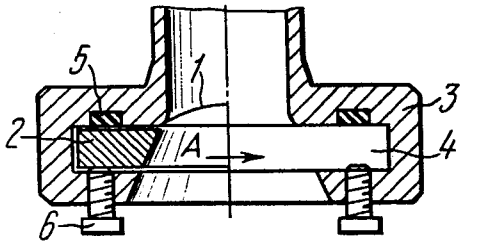
FIG. 1 shows a charged particle accelerator vacuum chamber, according to one embodiment of the invention, a longitudinal section along a shorter side at the exit window.

The charged particle accelerator vacuum chamber represents a metal bell expanding in the direction opposite to an accelerating tube (not shown) and comprises an exit window to extract charged particles to the atmosphere and consisting of a foil 1 (FIG. 1) and a frame 2, upon which the foil 1 is stretched and secured, and a flange 3, mounted on the end of the vacuum chamber away from the accelerating tube and designed for securing the exit window in the chamber. According to the invention, the frame 2 is inserted into guide slots 4 arranged along longer sides of the exit window, for example, in the inner part at the flange, the frame 2 with the foil 1 being not shown in the right side of FIG. 1. The packing gasket 5 laid into the groove provided in the flange 3 along the periphery of the foil 1 ensures a vacuum-tight connection of the foil 1 to the chamber.

Figure 2:
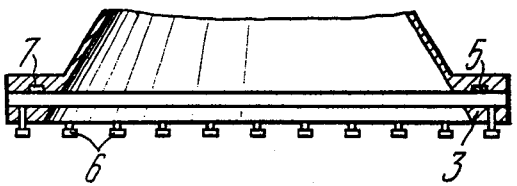
FIG. 2 shows the vacuum chamber of FIG. 1, viewed along the arrow A on reduced scale.

The frame 2 with the foil 1 is clamped to the flange 3 by backing-up screws 6, set in the lower part at the flange 3 around the foil 1. To insert the frame 2 into the guide slots 4 and to remove it out from the slots, for example, in order to replace the foil 1, there are provided through slits 7 in the shorter sides at the flange 3, (FIG. 2) i.e. along the shorter side of the exit window.

Figure 3:
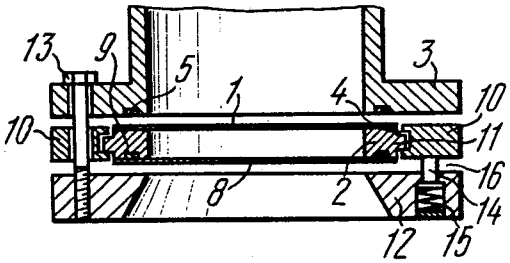
FIG. 3 represents a charged particle accelerator vacuum chamber, according to another embodiment of the invention, longitudinal section along a shorter side of the exit window.

FIG. 3 shows another embodiment of the proposed vacuum chamber, wherein the exit window comprises not only the upper foil 1 secured on the surface of the frame 3, facing the vacuum volume of the accelerator, but also a lower foil 8, fixed on the surface at the frame 2, facing the product to be irradiated (not shown). The lower foils are packed in the frame 2 by packing gasket 9 placed in a groove manufactured along the periphery of the frame 2. The space between the foils 1 and 8 is used for passing the air or other gas through to cool the foils (inlets of a gas cooling system are not shown in FIG. 3).

The vacuum chamber with two foils in the exit window is used, for example, in such a case, when cooling of the foil by gas from the side of the irradiated product is impossible because the surface of the treated product can be damaged by a stream of gas, or when irradiation is to be performed in a gaseous medium of a specific composition.

According to the embodiment of the vacuum chamber shown in FIG. 3, the guide slots 4 for mounting the frame 2 are made in racks 10 adjoining the flange 3 and located along both longer sides of the exit window. The frame 2 has projections 11, entering the guide slots 4. Besides the above-mentioned elements, the vacuum chamber comprises a clamping flange 12, disposed under racks 10 and connected to the flange 3 by coupling screws 13 passed through holes made in the racks 10. Between the coupling screws 13 in the clamping flange 12 supports 14 are mounted, the supports being loaded with springs 15 and pressed against the racks 10. Instead of springs 15, gaskets made of any elastic material, for example, rubber, may be used. Thanks to the supports 14, the frame 2 does not sink upon the clamping flange 12, when the coupling bolts 13 are weakened (on the drawing the unit is shown in this position). Thus, a gap 16 is formed between the foil 8 and the clamping flange 12, which eliminates any damage of the foil 8, which could otherwise occur as a result of a contact between the foil and the flange 12 while removing the frame 2 out of the vacuum chamber or while mounting the frame in the chamber.

It is apparent, that the racks 10 are not necessary in the case of two foils in the exit window. Particularly, the embodiment shown in FIGS. 1 and 2 may be used, but with the projections 11 (FIG. 3) on the frame 2 and with the clamping flange 12 (without the supports 14) and without backing-up screws 6 (FIG. 1). In this case the clamping flange 12 sinks when the coupling screws 13 (FIG. 3) are weakened, and the frame 2 will "hang down" in the guide slots 4 not touching the surface of the clamping flange 12 with its lower foil 8, thus allowing the frame 2 to slide in and out easily with no risk to damage the foils 1 and 8 due to friction against the flange 3 and 12. The design shown in FIG. 3 has an advantage since it can be realized on the vacuum chambers commercially available now which have a solid (without slots) flange only by adding the racks 10 and the clamping flange 12 to the standard unit.

Figure 4:
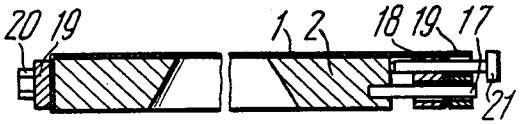
FIG. 4 shows the frame with the foil of the vacuum chamber of FIG. 1.

FIG. 4 shows fixation of the foil 1 on the frame 2 according to the invention. Giuding pins 17 arranged parallel to the plane of the frame 2 are screwed (or secured by other suitable method) into the side surface of the frame 2. A movable plank 18 is fitted loosely on the guiding pins 17. One end of the foil 1 is secured to the other side surface of the frame 2 by a clamping plank 19 and screws 20. The other end of the foil 1 is secured to the side surface of the movable plank 18 by means of the similar clamping plank 19 and the screws 20, which are not shown on the right part of FIG. 4. Tensioning screws 21, screwed into the movable plank 18 rest against the side surface of the frame 2 with their ends. Displacement of the movable plank 18 with respect to the frame 2 is performed by screwing and unscrewing of the coupling screws 21, and thus adjustment of the foil 1 tension on the frame is achieved.

Although the frame 2 is shown in FIG. 4 with only one foil 1, it is evident, that a similar construction can be used for two foils, fixed as shown in FIG. 3. In this case, two movable planks 18 arranged along both shorter sides of the frame 2 will be joined to the frame, one foil being secured to one movable plank, the other foil to the other movable plank.

Replacement of foil in the vacuum chamber shown in FIG. 1 is performed by weakening of the bracing-up screws 6, sliding the frame 2 out through a slit 7 (FIG. 2) and mounting a new frame with foil. Then the bracing-up screws 6 are tightened until the frame 2 is intimately pressed against the upper part of the flange 3, forming in combination with the gasket 5 a vacuum-tight connection with the chamber.

Replacement of the frame 2 in the vacuum chamber shown in FIG. 3 is performed by weakening of the coupling screws 13. This causes the racks 10 with the frame 2 to go down and to rest upon the supports 14, the gaps 16 between the foils 1, 8 and surfaces of the flanges 3, 12 respectively being formed. After branch pipes (not shown) of the gas cooling system are disconnected, the frame 2 is removed from the racks 10 and is replaced by a new one. The gaps 16 eliminate any mechanical contact of foils 1 and 8 with the flanges 3 and 12 both during removal of the old frame with the foil and during mounting of a new frame. The new frame 2 is sealed with the help of the gasket 5 with respect to the chamber by tightening the coupling screws 13, and is made gasproof with the help of a gasket 9 with respect to the gas cooling system. A gasket in the frame 2 under the upper foil 1 is not necessary since packing in this place is assured by the foil 1 itself as a result of pressure concentration upon the foil 1 from the gasket 5.

Thus, the replacement of foil in both considered designs of the proposed vacuum chamber is comparatively simple since one does not have to unscrew completely screws 6 (FIG. 1) or screws 13 (FIG. 2) to remove the frame 2, but just to weaken them sufficiently to allow the frame to move easily in the guide slots 4.

The foil 1 (FIG. 4) in the frame 2 is secured as follows. The movable plank 18 is mounted on the guide pins 17 screwed in the frame 2. The foil 1 is placed upon the surface of the frame, holes for screws 20 and 21 and for pins 17 having been previously made in the foil. The edges of the foil are bent at a right angle on the frame 2 and the plank 18 are clamped by planks 19 with the help of screws 20. Then, tensioning screws 21 are screwed into the movable plank 18. The required tension of the foil 1 is achieved by moving the plank 18 with respect to the frame 2.

Since the mounting of the foil 1 on the frame 2 is performed beforehand, and not at the moment when it is necessary to replace the foil in the chamber, all abovementioned operations do not increase time required to replace the foil, and thus do not result in additional down-time of the equipment including the accelerator.

COMMERCIAL APPLICABILITY

The present invention can be widely used in accelerators of commercial process, applied, for example for radiation and chemical treatment of materials, and in those of laboratory type, intended for scientific and research investigations in the field of radiation and chemical technology. The proposed vacuum chamber is more convenient in maintenance and saves time required to replace the foil and increases production rate of radiation and chemical equipment.

We claim:

1. A charged particle accelerator vacuum chamber including an exit window for extracting charged particles into the atmosphere, said vacuum chamber comprising: a flange in which the exit window is mounted, said flange including guide slots along a longer side of the exit window, and a frame having at least one foil secured thereto, the frame being slidably movable within said slots to permit the frame to be remove from the flange.

2. The vacuum chamber according to claim 1 wherein the guide slots are arranged in an inner part of the flange, said flange having through slits along a shorter side of the exit window for introducing the frame into the guide slots and for removing the frame out of the guide slots.

3. A vacuum chamber including an exit window having two foils therein with a gas cooling channel formed therebetween, said vacuum chamber comprising: a flange in which the exit window is mounted, two racks arranged along the longer sides of the exit window and adjoining the flange, guide slots formed in the racks, a frame carrying two spaced foils and having projections received in the guide slots, and a clamping flange connected with said exit window flange by coupling screws passing through holes in the racks and having spring-biased supports contacting the racks to provide a gap between the clamping flange and the frame when the coupling screws are loosened to insert the frame into the guide slots and to remove the frame from the guide slots.

4. The vacuum chamber according to claims 1, 2 or 3 further comprising at least one movable plank mounted on guiding pins secured to the shorter side of the frame, said plank being movable with respect to the frame, one end of the foil being secured to the other shorter side of the frame while the other end of the foil is secured to the movable plank, and tensioning screws screwed into the movable plank and having their ends resting against the frame to move the plank with respect to the frame, whereby foil tension on the frame is adjusted.

* * * * *